US009022882B2

(12) United States Patent
Umezawa et al.

(10) Patent No.: US 9,022,882 B2
(45) Date of Patent: May 5, 2015

(54) MULTI-PIECE SOLID GOLF BALL

(75) Inventors: Junji Umezawa, Chichibushi (JP); Hiroshi Higuchi, Chichibushi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 467 days.

(21) Appl. No.: 13/416,439

(22) Filed: Mar. 9, 2012

(65) Prior Publication Data

US 2013/0237345 A1 Sep. 12, 2013

(51) Int. Cl.
*A63B 37/06* (2006.01)
*A63B 37/00* (2006.01)

(52) U.S. Cl.
CPC ..... *A63B 37/0003* (2013.01); *A63B 37/0006* (2013.01); *A63B 37/0007* (2013.01); *A63B 37/0016* (2013.01); *A63B 37/0018* (2013.01); *A63B 37/0019* (2013.01); *A63B 37/002* (2013.01); *A63B 37/0021* (2013.01); *A63B 37/0022* (2013.01); *A63B 37/0029* (2013.01); *A63B 37/0031* (2013.01); *A63B 37/0033* (2013.01); *A63B 37/0035* (2013.01); *A63B 37/004* (2013.01); *A63B 37/0045* (2013.01); *A63B 37/0047* (2013.01); *A63B 37/0062* (2013.01); *A63B 37/0063* (2013.01); *A63B 37/0064* (2013.01); *A63B 37/0065* (2013.01); *A63B 37/0066* (2013.01); *A63B 37/0067* (2013.01); *A63B 37/0076* (2013.01); *A63B 37/008* (2013.01); *A63B 37/0081* (2013.01); *A63B 37/0084* (2013.01); *A63B 37/0096* (2013.01)

(58) Field of Classification Search
USPC ..... 473/377, 373, 374
See application file for complete search history.

(56) References Cited

U.S. PATENT DOCUMENTS

| | | | | |
|---|---|---|---|---|
| 5,306,760 | A | 4/1994 | Sullivan | |
| 5,312,857 | A | 5/1994 | Sullivan | |
| 5,743,816 | A | 4/1998 | Ohsumi et al. | |
| 6,277,924 | B1 | 8/2001 | Hamada et al. | |
| 6,290,612 | B1 | 9/2001 | Maruko et al. | |
| 6,569,036 | B1 | 5/2003 | Takemura et al. | |
| 6,626,770 | B2 | 9/2003 | Takemura et al. | |
| 6,642,314 | B2 | 11/2003 | Sone et al. | |
| 7,086,969 | B2 | 8/2006 | Higuchi et al. | |
| 7,160,208 | B2 | 1/2007 | Watanabe | |
| 7,175,542 | B2 | 2/2007 | Watanabe et al. | |
| 7,294,680 | B2 | 11/2007 | Sone et al. | |
| 7,344,455 | B1 * | 3/2008 | Higuchi | 473/377 |
| 7,367,901 | B2 | 5/2008 | Watanabe et al. | |
| 7,510,487 | B2 | 3/2009 | Yamagishi et al. | |
| 7,708,656 | B2 | 5/2010 | Sullivan et al. | |
| 8,734,173 | B2 * | 5/2014 | Suzuki et al. | 439/262 |
| 2011/0159999 | A1 * | 6/2011 | Ohama et al. | 473/376 |

FOREIGN PATENT DOCUMENTS

| | | | |
|---|---|---|---|
| JP | 7-268132 | A | 10/1995 |
| JP | 11-35633 | A | 2/1999 |
| JP | 2002-293996 | A | 10/2002 |
| WO | 98/46671 | A1 | 10/1998 |

* cited by examiner

*Primary Examiner* — Raeann Gorden
(74) *Attorney, Agent, or Firm* — Sughrue Mion, PLLC

(57) ABSTRACT

The invention provides a multi-piece solid golf ball having a solid core encased by a cover of one, two or more layers, which ball has specific hardness relationships among various areas on a core cross-section obtained by cutting the solid core in half. The golf ball has a reduced spin rate on shots with a driver (W#1) and thus is able to achieve an increased distance. A good feel on impact can also be obtained.

11 Claims, 3 Drawing Sheets

MULTI-PIECE SOLID GOLF BALL

BACKGROUND OF THE INVENTION

The present invention relates to a multi-piece solid golf ball having a solid core and a cover of one, two or more layers encasing the core. More specifically, the invention relates to a multi-piece solid golf ball which has an excellent flight performance on shots with a driver (W#1) or a middle iron.

Golf balls are commonly designed with a multilayer structure so as to increase the distance traveled by the ball and improve the feel of the ball when played. Such designs are often augmented by improvements not only to the cover but also to the core interior for the purpose of lowering the spin rate, increasing the initial velocity and further enhancing head speed (HS) dependence and feel on impact. Various multi-piece golf balls embodying such design innovations and improvements are described in the art.

For example, U.S. Pat. Nos. 6,290,612, 7,086,969, 7,160,208, 7,175,542 and 7,367,901 disclose golf balls having a solid core with a two-layer structure and a cover. In addition, U.S. Pat. Nos. 7,510,487, 6,569,036, 6,626,770, 5,743,816 and 7,708,656 disclose golf balls having a solid core with a three-layer structure. However, all of these conventional golf balls lack a sufficient initial velocity when hit with a driver (W#1) or do not have a good feel on impact, and so further improvement has been desired.

SUMMARY OF THE INVENTION

It is therefore an object of the present invention to provide a multi-piece solid golf ball which has a core that satisfies specific hardness conditions and which, by reducing the spin rate, is able to increase the distance traveled by the ball on shots with a driver (W#1) or a middle iron.

As a result of extensive investigations aimed at achieving the above objects, the inventors have discovered that, in a golf ball having a solid core encased by a cover, by optimizing the hardness relationships among various areas at the core interior, on shots with a driver (W#1) or a middle iron, the spin rate is reduced, enabling the flight performance to be improved.

Accordingly, the invention provides the following multi-piece solid golf balls.

[1] A multi-piece solid golf ball comprising a solid core encased by a cover of one, two or more layers, wherein, letting (a) represent a JIS-C cross-sectional hardness at a center of the core on a cross-section obtained by cutting the core in half, (b) represent a JIS-C cross-sectional hardness at a position 7 mm from the core center, (c) represent a JIS-C cross-sectional hardness at a position 11 mm from the core center, and (d) represent a JIS-C surface hardness of the core:

the cross-sectional hardness (a) is in the range of 30 to 60, the value (b)−(a) is in the range of 0 to 40, the value (d)−(c) is in the range of 0 to 40, and the value (a)+(b)+(c)+(d) is in the range of 245 to 300.

[2] The multi-piece solid golf ball of [1], wherein the value (d)−(a) in the solid core is in the range of 25 to 55.

[3] The multi-piece solid golf ball of [1], wherein the cross-sectional hardness (b) of the solid core is in the range of 45 to 65.

[4] The multi-piece solid golf ball of [1], wherein the ratio between the deflection of the solid core when compressed under a final load of 1,275 N (130 kgf) from an initial load state of 98 N (10 kgf) to the deflection of the ball when compressed under a final load of 1,275 N (130 kgf) from an initial load state of 98 N (10 kgf) (solid core deflection/ball deflection) is from 1.30 to 1.90.

[5] The multi-piece solid golf ball of [1], wherein the ratio between the deflection of the ball when compressed under a final load of 5,880 N (600 kgf) from an initial load state of 98 N (10 kgf) and the deflection of the ball when compressed under a final load of 1,275 N (130 kgf) from an initial load state of 98 N (10 kgf) (600 kgf deflection/130 kgf deflection) is from 3.50 to 3.90.

[6] The multi-piece solid golf ball of [1], wherein the ratio between the value (d)−(c) and the value (b)−(a), expressed as [(d)−(c)]/[(b)−(a)], is from 3 to 10.

[7] The multi-piece solid golf ball of [1], wherein the ratio between the value (d)−(c) and the value (c)−(b), expressed as [(d)−(c)]/[(c)−(b)], is from 3 to 8.

DETAILED DESCRIPTION OF THE INVENTION

Figure 1:
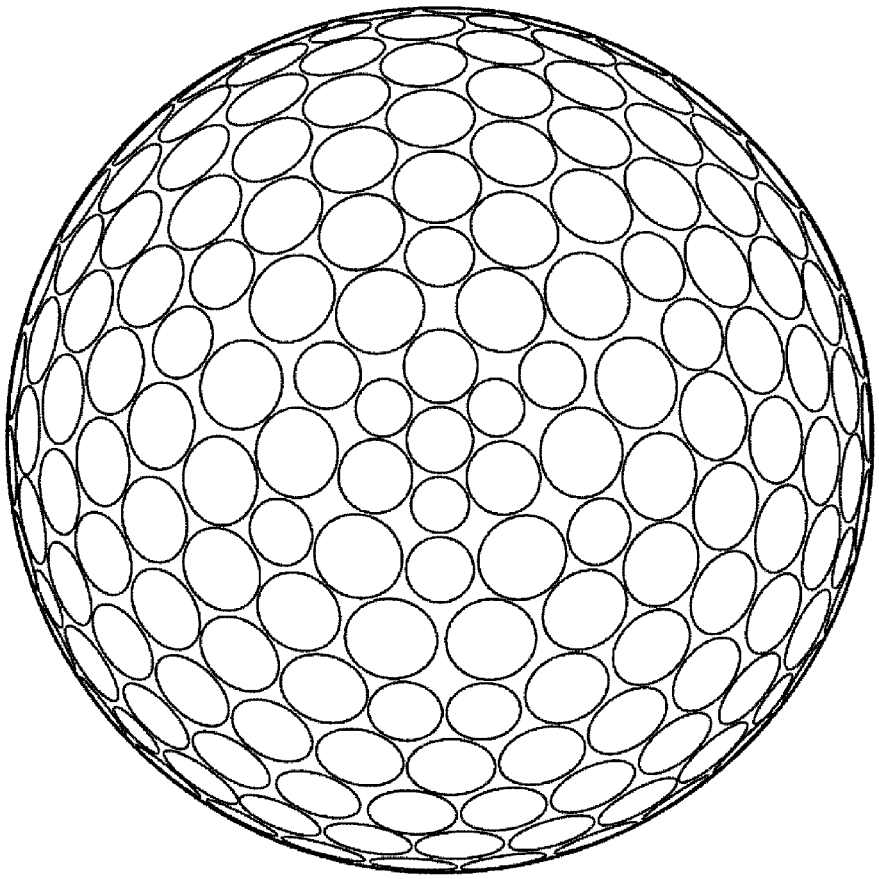
FIG. 1 is a plan view showing the dimple pattern used on balls in the examples of the invention.
Figure 2A:
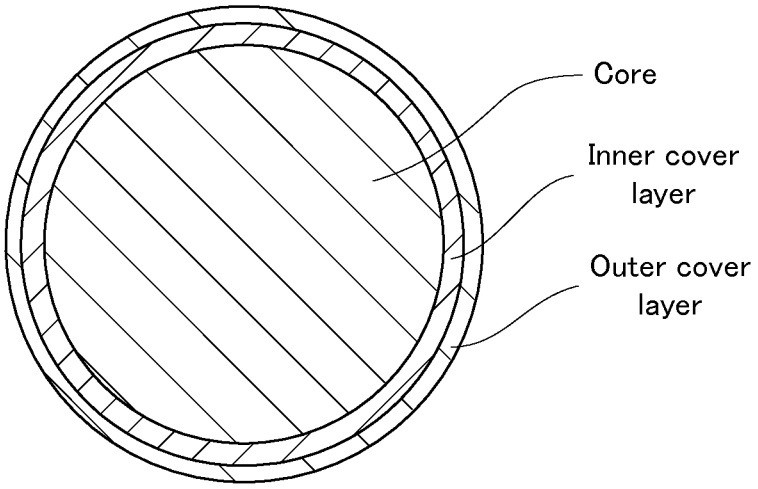
FIG. 2A is a schematic sectional view showing a multi-piece solid golf ball of the present invention comprising a solid core and a cover layer having an inner cover layer and an outer cover layer.
Figure 2B:
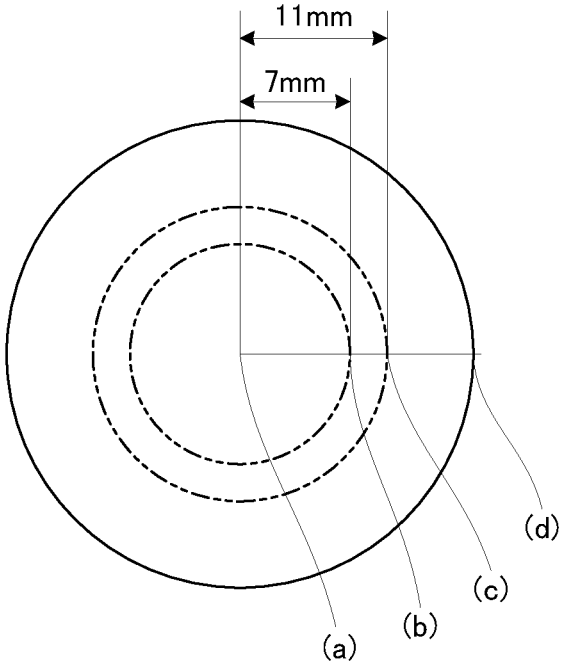
FIG. 2B is a diagram illustrating positions at the interior of a core of a multi-piece solid golf ball of the present invention.

The present invention is described more fully below.

The multi-piece solid golf ball of the invention, although not shown in an accompanying diagram, is composed of a solid core that satisfies the hardness conditions set forth below, which solid core is encased by a cover of one, two or more layers.

The golf ball of the present invention has been optimized by setting the hardness relationships inside the solid core as follows. Specifically, letting (a) represent a JIS-C cross-sectional hardness at a center of the solid core on a cross-section obtained by cutting the core in half, (b) represent a JIS-C cross-sectional hardness at a position 7 mm from the core center, (c) represent a JIS-C cross-sectional hardness at a position 11 mm from the core center, and (d) represent a JIS-C surface hardness of the core, it is critical for:

the cross-sectional hardness (a) to be in the range of 30 to 60,
the value (b)−(a) to be in the range of 0 to 40,
the value (d)−(c) to be in the range of 0 to 40; and
the value (a)+(b)+(c)+(d) to be in the range of 245 to 300.

The hardnesses (a) to (d) at the various cross-sectional areas of the solid core are described in detail below.

The cross-sectional hardness (a) at the center of the core, although not subject to any particular limitation, may be set to a value, expressed as the JIS-C hardness, of at least 30, preferably at least 35, more preferably at least 40, and even more preferably at least 45. The upper limit, although not subject to any particular limitation, may be set to a value, expressed as the JIS-C hardness, of not more than 60, preferably not more than 55, and more preferably not more than 50. If the cross-sectional hardness (a) is too small, a sufficient initial velocity may not be obtained on shots with a W#1. On the other hand, if it is too large, the spin rate on shots with a W#1 may be excessive.

The cross-sectional hardness (b) at a position 7 mm from the core center, although not subject to any particular limitation, may be set to a value, expressed as the JIS-C hardness, of at least 45, preferably at least 50, and more preferably at least 52. The upper limit, although not subject to any particular limitation, may be set to a value, expressed as the JIS-C hardness, of not more than 65, preferably not more than 60, and more preferably not more than 58. If the cross-sectional hardness (b) is too small, the rebound may decrease. On the other hand, if it is too large, the spin rate on shots with a W#1 may be excessive.

The cross-sectional hardness (c) at a position 11 mm from the core center, although not subject to any particular limitation, may be set to a value, expressed as the JIS-C hardness, of at least 45, preferably at least 50, and more preferably at least 55. The upper limit, although not subject to any particular limitation, may be set to a value, expressed as the JIS-C hardness, of not more than 75, preferably not more than 70, and more preferably not more than 65. If the cross-sectional hardness (c) is too small, the rebound may decrease. On the other hand, if it is too large, the spin rate on shots with a W#1 may be excessive.

The surface hardness (d) of the core, although not subject to any particular limitation, may be set to a value, expressed as the JIS-C hardness, of at least 70, preferably at least 75, and more preferably at least 80. The upper limit, although not subject to any particular limitation, may be set to a value, expressed as the JIS-C hardness, of not more than 95, and preferably not more than 90.

The value (b)−(a), as mentioned above, must be set to from 0 to 40. The lower limit in this value is preferably at least 3, and more preferably at least 5. The upper limit in this value is preferably not more than 30, and more preferably not more than 20. If the value (b)−(a) is too large, the durability to cracking may be inadequate; if it is too small, a sufficient initial velocity may not be obtained on shots with a W#1.

The value (d)−(c), as mentioned above, must be set to from 0 to 40. The lower limit in this value is preferably at least 10, and more preferably at least 20. The upper limit in this value is preferably not more than 35, and more preferably not more than 30. If the value (d)−(c) is too large, the durability to cracking may be inadequate; if it is too small, the spin rate on shots with a W#1 may become too high, as a result of which a good distance may not be achieved.

The value (d)−(a), although not subject to any particular limitation, is preferably set to from 25 to 55. The lower limit in this value is more preferably at least 27, and even more preferably at least 30. The upper limit in this value is more preferably not more than 50, and even more preferably not more than 45. If the value (d)−(a) is too large, the durability to cracking may be inadequate; if it is too small, the spin rate on shots with a W#1 may become too high, as a result of which a good distance may not be achieved.

The value (a)+(b)+(c)+(d), as mentioned above, must be set to from 245 to 300. The lower limit in this value is more preferably at least 250. The upper limit in this value is more preferably not more than 290, and even more preferably not more than 285. If the value (a)+(b)+(c)+(d) is too large, the feel on impact may become too hard; if it is too small, a sufficient rebound may not be obtained.

The ratio [(d)−(c)]/[(b)−(a)] has a value which, although not subject to any particular limitation, is preferably from 3 to 10. The lower limit is more preferably at least 4, and the upper limit is more preferably not more than 8, and even more preferably not more than 6. If the value of [(d)−(c)]/[(b)−(a)] is too small, the spin rate on shots with a W#1 may increase, as a result of which a sufficient distance may not be achieved. On the other hand, if the value is too large, the ball may not have a sufficient durability to cracking.

The ratio [(d)−(c)]/[(c)−(b)] has a value which, although not subject to any particular limitation, is preferably from 3 to 8. The lower limit is more preferably at least 4, and even more preferably at least 5. The upper limit is more preferably not more than 6. If the value of [(d)−(c)]/[(c)−(b)] is too small, the spin rate on shots with a W#1 may increase, as a result of which a sufficient distance may not be achieved. On the other hand, if the value is too large, the ball may not have a sufficient durability to cracking.

As noted above, by optimizing the hardnesses (a) to (d) of the various cross-sectional areas of the solid core, a lower spin rate is achieved on shots with a driver (W#1) or a middle iron, enabling the flight performance to be improved. Above hardnesses (a) to (d) refer to the hardness values measured with a spring durometer (JIS type C), as specified in JIS K 6301-1975.

The solid core, so long as it satisfies the foregoing hardness conditions, may have either a single-layer structure in which the entire core is formed of a material composed primarily of the same type of base rubber or base resin or a multilayer structure of two or more successive layers formed of different materials. For the purposes of this invention, in cases where the above structure is one wherein layers formed of materials composed primarily of the same base rubber or base resin are mutually adjacent, the layers shall be regarded as a single layer. That is, even in cases where layers of the same material have been formed in a plurality of discrete operations so as to regulate the hardnesses at the interior of the core, if the overall core is formed of the same type of material, then the core shall be considered to have a single-layer structure.

The materials of which the solid core may be formed are not subject to any particular limitation. For example the core may be formed using a rubber composition containing polybutadiene as the base rubber or using a resin composition composed primarily of a thermoplastic resin.

First, the use of a rubber composition is described.

The use of polybutadiene as the base rubber of the rubber composition is preferred. The polybutadiene is not subject to any subject to any particular limitation, although the use of a polybutadiene having a cis-1,4 bond content of a least 60%, preferably at least 80%, more preferably at least 90%, and most preferably at least 95%, is recommended.

It is recommended that the polybutadiene, although not subject to any particular limitation, have a Mooney viscosity ($ML_{1+4}$ (100° C.)) of at least 30, preferably at least 35, more preferably at least 40, even more preferably at least 50, and most preferably at least 52. It is recommended that the upper limit, although not subject to any particular limitation, be not more than 100, preferably not more than 80, more preferably not more than 70, and even more preferably not more than 60.

The term "Mooney viscosity" used herein refers to an industrial indicator of viscosity (JIS K6300) as measured with a Mooney viscometer, which is a type of rotary plastometer. This value is represented by the unit symbol $ML_{1+4}$ (100° C.), wherein "M" stands for Mooney viscosity, "L" stands for large rotor (L-type), and "1+4" stands for a pre-heating time of 1 minute and a rotor rotation time of 4 minutes. The "100° C." indicates that measurement was carried out at a temperature of 100° C.

In addition, the polybutadiene has a molecular weight distribution Mw/Mn (Mw: weight-average molecular weight; Mn: number-average molecular weight) which, although not subject to any particular limitation, is at least 2.0, preferably at least 2.2, more preferably at least 2.4, and even more preferably at least 2.6. The upper limit, although not subject to any particular limitation, is typically not more than 6.0, preferably not more than 5.0, more preferably not more than 4.0, and even more preferably not more than 3.4. If Mw/Mn is too small, the workability may decrease; if Mw/Mn is too large, the resilience may decrease.

The polybutadiene used may be one which has been synthesized using a nickel catalyst, a cobalt catalyst, a Group VIII metal catalyst or a rare-earth catalyst. In this invention, it is preferable to use a polybutadiene synthesized with, in particular, a nickel catalyst and a rare-earth catalyst. Also, where necessary, an organoaluminum compound, an alumoxane, a halogen-bearing compound, a Lewis base and the like may be used in combination with these catalysts. In this invention, it is preferable to use, as the various above-mentioned compounds, those mentioned in JP-A 11-35633.

Of the above rare-earth catalysts, the use of a neodymium catalyst that employs a neodymium compound, which is a lanthanide series rare-earth compound, is especially recommended because it enables a polybutadiene rubber having a high cis-1,4 bond content and a low 1,2-vinyl bond content to be obtained at an excellent polymerization activity.

The polymerization of butadiene in the presence of a rare-earth catalyst may be carried out by bulk polymerization or vapor phase polymerization, either with or without the use of a solvent, and at a polymerization temperature in the range of generally −30 to 150° C., and preferably 10 to 100° C.

The above polybutadiene may be one obtained by polymerization using the aforementioned rare-earth catalyst, followed by the reaction of a terminal modifier with active end groups on the polymer.

Specific examples of the terminal modifier and methods for their reaction are described in, for example, JP-A 11-35633, JP-A 7-268132 and JP-A 2002-293996.

It is recommended that the amount of the above polybutadiene included in the base rubber, although not subject to any particular limitation, be at least 60 wt %, preferably at least 70 wt %, more preferably at least 80 wt %, and even more preferably at least 90 wt %, and that the upper limit be 100 wt % or less, preferably 98 wt % or less, and more preferably 95 wt % or less. If the content is inadequate, it may be difficult to obtain golf balls conferred with a good rebound.

Aside from the above polybutadiene, other rubber ingredients may also be included in the base rubber, insofar as the objects of the invention are attainable. Illustrative examples include polybutadiene rubbers (BR), styrene-butadiene rubbers (SBR), natural rubbers, polyisoprene rubbers and ethylene-propylene-diene rubbers (EPDM). These may be used singly or as a combination of two or more types.

In this rubber composition, additives such as an unsaturated carboxylic acid or a metal salt thereof, an organosulfur compound, an inorganic filler, an organic peroxide and an antioxidant may be blended in given amounts with the above base rubber.

Illustrative examples of the unsaturated carboxylic acid include acrylic acid, methacrylic acid, maleic acid and fumaric acid. The use of acrylic acid or methacrylic acid is especially preferred.

Illustrative examples of metal salts of unsaturated carboxylic acids include zinc salts and magnesium salts of unsaturated fatty acids, such as zinc methacrylate and zinc acrylate. The use of zinc acrylate is especially preferred.

The amount of the unsaturated carboxylic acid and/or a metal salt thereof included in the rubber composition, although not subject to any particular limitation, may be set to preferably at least 10 parts by weight, and more preferably at least 15 parts by weight, per 100 parts by weight of the base rubber. It is recommended that the upper limit, although not subject to any particular limitation, be set to not more than 50 parts by weight. If the amount included is too high, the ball may become too hard, resulting in an unpleasant feel on impact. On the other hand, if the amount is too low, the rebound may decrease.

An organosulfur compound may be optionally included. The organosulfur compound can be advantageously used to impart an excellent rebound. Thiophenols, thionaphthols, halogenated thiophenols, and metal salts thereof are recommended for this purpose. Illustrative examples include pentachlorothiophenol, pentafluorothiophenol, pentabromothiophenol, p-chlorothiophenol, and the zinc salt of pentachlorothiophenol; and diphenylpolysulfides, dibenzylpolysulfides, dibenzoylpolysulfides, dibenzothiazoylpolysulfides and dithiobenzoylpolysulfides having 2 to 4 sulfurs. Diphenyldisulfide and the zinc salt of pentachlorothiophenol are especially preferred.

The amount of the organosulfur compound included can be set to more than 0, and may be set to preferably at least 0.1 part by weight, more preferably at least 0.2 part by weight, and even more preferably at least 0.4 part by weight, per 100 parts by weight of the base rubber. The upper limit in the amount included, although not subject to any particular limitation, may be set to preferably not more than 5 parts by weight, more preferably not more than 4 parts by weight, even more preferably not more than 3 parts by weight, and most preferably not more than 2 parts by weight. Including too much organosulfur compound may excessively lower the hardness, whereas including too little is unlikely to improve the rebound.

The inorganic filler is exemplified by zinc oxide, barium sulfate and calcium carbonate. The amount of the inorganic filler included is not subject to any particular limitation, although it may be set to preferably at least 5 parts by weight, more preferably at least 6 parts by weight, even more preferably at least 7 parts by weight, and most preferably at least 8 parts by weight, per 100 parts by weight of the base rubber. The upper limit in the amount included may be set to preferably not more than 80 parts by weight, more preferably not more than 60 parts by weight, even more preferably not more than 40 parts by weight, and most preferably not more than 20 parts by weight. Too much or too little inorganic filler may make it impossible to achieve a suitable weight and a good rebound.

To increase the hardness profile, the organic peroxide used is preferably one having a relatively short half-life. Specifically, use is made of an organic peroxide which has a half-life at 155° C. (at) of preferably at least 5 seconds, more preferably at least 10 seconds, and even more preferably at least 15 seconds. Moreover, the organic peroxide used has a half-life at 155° C. (at) of preferably not more than 120 seconds, more preferably not more than 90 seconds, and even more preferably not more than 60 seconds. Examples of organic peroxides which satisfy these conditions include 1,1-bis(t-hexylperoxy)cyclohexane (trade name, Perhexa HC), 1-1-bis(t-hexylperoxy)-3,3,5-trimethylcyclohexane (trade name, Perhexa TMH), 1,1-bis(t-butylperoxy)-3,3,5-trimethylcyclohexane (trade name, Perhexa 3M) and 1-bis(t-butylperoxy)-cyclohexane (trade name, Perhexa C). These are all available from NOF Corporation.

The organic peroxide is included in an amount which, although not subject to any particular limitation, is preferably at least 0.3 part by weight, more preferably at least 0.4 part by weight, and even more preferably at least 0.5 part by weight, per 100 parts by weight of the base rubber. The upper limit in the amount of organic peroxide is not subject to any particular limitation, although it is recommended that it be preferably not more than 4 parts by weight, more preferably not more than 3 parts by weight, even more preferably not more than 2 parts by weight, and most preferably not more than 1.5 parts by weight. In this invention, to achieve a suitable rebound and durability, it is preferable for the amount of organic peroxide to be set in the above-indicated range. If the amount of organic peroxide is too high, the rebound and durability may decline. On the other hand, if the amount of organic peroxide is too low, the time required for crosslinking may increase, possibly resulting in a large decline in productivity and also a large decline in compression.

If necessary, an antioxidant may be included in the rubber composition. Illustrative examples of the antioxidant include commercial products such as Nocrac NS-6 and Nocrac NS-30 (both available from Ouchi Shinko Chemical Industry Co., Ltd.), and Yoshinox 425 (Yoshitomi Pharmaceutical Industries, Ltd.).

The amount of antioxidant included can be set to more than 0, and may be set to preferably at least 0.03 part by weight, and more preferably at least 0.05 part by weight, per 100 parts by weight of the base rubber. The upper limit in the amount of antioxidant, although not subject to any particular limitation, may be set to preferably not more than 0.4 part by weight, more preferably not more than 0.3 part by weight, and even more preferably not more than 0.2 part by weight. In this invention, it is recommended that the amount of the antioxidant be set within the above range so as to enable a suitable rebound and durability to be achieved.

Sulfur may also be added if necessary. Such sulfur is exemplified by the product manufactured by Tsurumi Chemical Industry Co., Ltd. under the trade name Sulfur Z. The amount of sulfur included can be set to more than 0, and may be set to preferably at least 0.005 part by weight, and more preferably at least 0.01 part by weight, per 100 parts by weight of the base rubber. The upper limit in the amount of sulfur, although not subject to any particular limitation, may be set to preferably not more than 0.5 part by weight, more preferably not more than 0.4 part by weight, and even more preferably not more than 0.1 part by weight. By adding sulfur, the hardness profile of the core can be increased. However, adding too much sulfur may result in undesirable effects during hot molding, such as explosion of the rubber composition, or may considerably lower the rebound.

When the core is produced using the above rubber composition, in order to obtain cross-sectional hardnesses which satisfy the above conditions, the foregoing rubber composition is suitably selected and fabrication may be carried out by vulcanization and curing according to a method similar to that used for conventional golf ball rubber compositions. Suitable vulcanization conditions include, for example, a vulcanization temperature of between 100° C. and 200° C., and a vulcanization time of from 10 to 40 minutes. To obtain the desired rubber crosslinked body for use as the core in the present invention, the vulcanizing temperature is preferably at least 150° C., and especially at least 155° C., but preferably not above 200° C., more preferably not above 190° C., even more preferably not above 180° C., and most preferably not above 170° C.

The solid core may be molded in a plurality of discrete operations so as to finely regulate the hardness relationships at the interior thereof. The molding method may be a known method and is not subject to any particular limitation, although preferred use may be made of the following method. First, a predetermined rubber composition is placed in a predetermined mold and subjected to primary vulcanization (semi-vulcanization) so as to produce a pair of hemispherical half-cups. Then, a prefabricated spherical body to be covered is enclosed within the half-cups produced as just described, and secondary vulcanization (complete vulcanization) is carried out in this state. That is, advantageous use may be made of a method in which the vulcanization step is divided into two stages. Alternatively, advantageous use may be made of a method in which a rubber composition is injection-molded over the spherical body to be covered. The number of molding operations is not subject to any particular limitation, provided the above-described hardness conditions can be satisfied. For the purposes of this invention, so long as the entire core is formed of the same type of material, the core is regarded as having a single-layer structure.

Next, the use of a resin composition is described.

Illustrative, non-limiting, examples of thermoplastic resins which may be used in the resin composition include nylons, polyarylates, ionomer resins, polypropylene resins, polyurethane-type thermoplastic elastomers and polyester-type thermoplastic elastomers. Commercial products which may be suitably used as these resins include Surlyn AD8512 (an ionomer resin available from E.I. DuPont de Nemours and Co.), Himilan 1706 and Himilan 1707 (both ionomer resins available from DuPont-Mitsui Polychemicals Co., Ltd.), Rilsan BMNO (a nylon resin available from Arkema) and U-Polymer U-8000 (a polyarylate resin available from Unitika, Ltd.).

In the present invention, of the above thermoplastic resins, it is especially desirable to use an ionomer resin, an unneutralized form thereof, or a highly neutralized ionomer resin. The ionomer resin or unneutralized form thereof is preferably a resin composition in which the following resin components A-I and A-II serve as the base resins:

(A-I) an olefin-unsaturated carboxylic acid-unsaturated carboxylic acid ester ternary random copolymer and/or a metal salt thereof; and (A-II) an olefin-unsaturated carboxylic acid binary random copolymer and/or a metal salt thereof.

This resin composition is described below.

The olefin-unsaturated carboxylic acid-unsaturated carboxylic acid ester ternary random copolymer and/or metal salt thereof serving as component A-I has a weight-average molecular weight (Mw) of preferably at least 100,000, more preferably at least 110,000, and even more preferably at least 120,000. The upper limit is preferably not more than 200,000, more preferably not more than 190,000, and even more preferably not more than 180,000. The weight-average molecular weight (Mw) to number-average molecular weight (Mn) ratio of the copolymer is preferably at least 3, and more preferably at least 4.5, with the upper limit being preferably not more than 7, and more preferably not more than 6.5.

The olefin-unsaturated carboxylic acid binary random copolymer and/or metal salt thereof serving as component A-II has a weight-average molecular weight (Mw) of preferably at least 150,000, more preferably at least 160,000, and even more preferably at least 170,000. The upper limit is preferably not more than 200,000, more preferably not more than 190,000, and even more preferably not more than 180,000. The weight-average molecular weight (Mw) to number-average molecular weight (Mn) ratio is preferably at least 3, and more preferably at least 4.5, with the upper limit being preferably not more than 7, and more preferably not more than 6.5.

Here, the weight-average molecular weight (Mw) and number-average molecular weight (Mn) are values calculated relative to polystyrene in gel permeation chromatography (GPC). A word of explanation is needed here concerning GPC molecular weight measurement. It is not possible to directly take GPC measurements for binary copolymers and ternary copolymers because these molecules are adsorbed to the GPC column owing to the unsaturated carboxylic acid groups within the molecules. Instead, the unsaturated carboxylic acid groups are generally converted to esters, following which GPC measurement is carried out and the polystyrene-equivalent average molecular weights Mw and Mn are calculated.

The olefins in components A-I and A-II are exemplified by olefins in which the number of carbons is at least 2, but not more than 8, and preferably not more than 6. Illustrative examples of such olefins include ethylene, propylene, butene, pentene, hexene, heptene and octene. Ethylene is especially preferred.

Illustrative examples of the unsaturated carboxylic acid include acrylic acid, methacrylic acid, maleic acid and fumaric acid. Acrylic acid and methacrylic acid are especially preferred.

The unsaturated carboxylic acid ester included in component A-I is preferably a lower alkyl ester of the above-described unsaturated carboxylic acid. Illustrative examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The random copolymer used as component A-I or component A-II may be obtained by random copolymerization of the above ingredients in accordance with a known method. Here, the content of unsaturated carboxylic acid (acid content) included in the random copolymer, although not subject to any particular limitation, is preferably at least 2 wt %, more preferably at least 6 wt %, and even more preferably at least 8 wt %. It is recommended that the upper limit, although not subject to any particular limitation, be not more than 25 wt %, more preferably not more than 20 wt %, and even more preferably not more than 15 wt %. At a low acid content, the rebound may decrease, whereas at a high acid content, the processability of the material may decrease.

It is essential to set the relative proportions in the contents of component A-I and component A-II, expressed as the weight ratio therebetween, at generally from 100:0 to 0:100, preferably from 100:0 to 25:75, more preferably from 100:0 to 50:50, even more preferably from 100:0 to 75:25, and most preferably 100:0. If the content of component A-II is too low, moldings of the material may have a decreased resilience.

The metal salts of the copolymer in above components A-I and A-II may be obtained by partially neutralizing the acid groups in the random copolymers of components A-I and A-II with metal ions. Here, specific examples of the metal ions which neutralize the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. In the invention, of these, preferred use may be made of $Na^+$, $Li^+$, $Zn^{++}$, $Mg^{++}$ and $Ca^{++}$. $Zn^{++}$ and $Mg^{++}$ are especially preferred.

In cases where metal neutralization products of the above copolymers are used as components A-I and A-II, i.e., in cases where an ionomer resin is used, the type of metal neutralization product and the degree of neutralization are not subject to any particular limitation. Specific examples include 60 mol % Zn (degree of neutralization with zinc) ethylene-acrylic acid copolymers, 40 mol % Mg (degree of neutralization with magnesium) ethylene-acrylic acid copolymers, 40 mol % Mg (degree of neutralization with magnesium) ethylene-methacrylic acid-isobutylene acrylate terpolymers, and 60 mol % Zn (degree of neutralization with zinc) ethylene-methacrylic acid-isobutylene acrylate terpolymers.

Illustrative examples of the olefin-unsaturated carboxylic acid-unsaturated carboxylic acid ester ternary random copolymer of component A-I include those available under the trade names Nucrel AN4318, Nucrel AN4319, Nucrel AN4311, Nucrel NO35C and Nucrel NO200H (DuPont-Mitsui Polychemicals Co., Ltd.). Illustrative examples of the metal salts of olefin-unsaturated carboxylic acid-unsaturated carboxylic acid ester ternary random copolymers include those available under the trade names Himilan AM7316, Himilan AM7331, Himilan 1855 and Himilan 1856 (DuPont-Mitsui Polychemicals Co., Ltd.), and those available under the trade names Surlyn 6320 and Surlyn 8120 (E.I. DuPont de Nemours and Co., Ltd.).

Illustrative examples of the olefin-unsaturated carboxylic acid binary random copolymer of component A-II include those available under the trade names Nucrel 1560, Nucrel 1525 and Nucrel 1035 (DuPont-Mitsui Polychemicals Co., Ltd.). Illustrative examples of the metal salts of olefin-unsaturated carboxylic acid binary random copolymers include those available under the trade names Himilan 1605, Himilan 1601, Himilan 1557, Himilan 1705 and Himilan 1706 (DuPont-Mitsui Polychemicals Co., Ltd.); those available under the trade names Surlyn 7930 and Surlyn 7920 (E.I. DuPont de Nemours and Co., Ltd.); and those available under the trade names Escor 5100 and Escor 5200 (ExxonMobil Chemical).

In addition, to achieve a good rebound, use may be made of a highly neutralized ionomer resin in which the degree of neutralization has been increased by mixing the subsequently described (B) fatty acid or fatty acid derivative having a molecular weight of at least 280 but not more than 1,500 and (C) a basic inorganic metal compound with above components A-I and A-II under applied heat.

Component B is a fatty acid or fatty acid derivative having a molecular weight of at least 280 but not more than 1,500 whose purpose is to increase the flow properties of the heated mixture. Compared with the thermoplastic resins of component A, it has a much smaller molecular weight and helps to significantly decrease the melt viscosity of the mixture. Also, because the fatty acid (or fatty acid derivative) of component B has a molecular weight of at least 280 but not more than 1,500 and has a high content of acid groups (or derivative moieties thereof), its addition results in little if any loss of resilience.

The fatty acid or fatty acid derivative serving as component B may be an unsaturated fatty acid (or fatty acid derivative) having a double bond or triple bond on the alkyl moiety, or it may be a saturated fatty acid (or fatty acid derivative) in which all the bonds on the alkyl moiety are single bonds. It is recommended that the number of carbons on the molecule be generally at least 18, but not more than 80, and preferably not more than 40. Too few carbons may result in a poor heat resistance, and may also set the acid group content so high as to cause the acid groups to interact with acid groups present on the base resin, as a result of which the desired flow properties may not be achieved. On the other hand, too many carbons increases the molecular weight, which may lower the flow properties. In either case, the material may become difficult to use.

Specific examples of fatty acids that may be used as component B include stearic acid, 12-hydroxystearic acid, behenic acid, oleic acid, linoleic acid, linolenic acid, arachidic acid and lignoceric acid. Of these, preferred use may be made of stearic acid, arachidic acid, behenic acid, lignoceric acid and oleic acid.

The fatty acid derivative is exemplified by derivatives in which the proton on the acid group of the fatty acid has been substituted. Exemplary fatty acid derivatives of this type include metallic soaps in which the proton has been substituted with a metal ion. Metal ions that may be used in such metallic soaps include $Li^+$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component B include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

The content of component B per 100 parts by weight of the base resin is at least 30 parts by weight, preferably at least 45 parts by weight, more preferably at least 60 parts by weight, and even more preferably at least 80 parts by weight. The upper limit in the content is not more than 170 parts by weight, preferably not more than 150 parts by weight, even more preferably not more than 130 parts by weight, and most preferably not more than 110 parts by weight.

Use may also be made of known metallic soap-modified ionomer resins (see, for example, U.S. Pat. Nos. 5,312,857 and 5,306,760, and International Disclosure WO 98/46671) when using above component A.

The basic inorganic metal compound serving as component C is included for the purpose of neutralizing the acid groups in above components A and B. As mentioned in prior-art examples, when components A and B alone, and in particular metal-modified ionomer resins alone (e.g., metal soap-modified ionomer resins of the types mentioned in the foregoing patent publications, alone), are heated and mixed, as shown below, the metal soap and unneutralized acid groups present on the ionomer resin undergo exchange reactions, forming a fatty acid. Because the fatty acid thus formed has a low thermal stability and readily vaporizes during molding, it causes molding defects. Moreover, if the fatty acid thus formed deposits on the surface of the molding, it may substantially lower paint film adhesion.

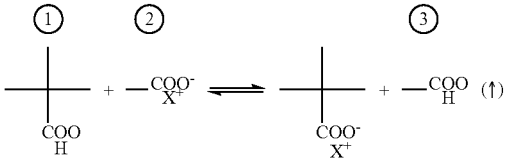

(1) unneutralized acid group present on ionomer resin
(2) metallic soap
(3) fatty acid
X: metal atom In this invention, the inclusion of above component C neutralizes the acid groups present in above components A and B, making it possible to suppress the formation of fatty acids which cause trouble such as molding defects. By thus including component C and suppressing fatty acid formation, the thermal stability of the material increases and, at the same time, a good moldability is conferred. As a result, the golf ball material is imparted with the outstanding property of having an improved resilience.

It is recommended that component C be a basic inorganic metal compound—preferably a monoxide or hydroxide—which is capable of neutralizing acid groups in above components A and B. Because such compounds have a high reactivity with the ionomer resin and the reaction by-products contain no organic matter, the degree of neutralization of the resin composition can be increased without a loss of thermal stability.

The metal ions used here in the basic inorganic metal compound are exemplified by $Li^+$, $Na^+$, $K^+$, $Ca^{++}$, $Mg^{++}$, $Zn^{++}$, $Al^{+++}$, $Ni^+$, $Fe^{++}$, $Fe^{+++}$, $Cu^{++}$, $Mn^{++}$, $Sn^{++}$, $Pb^{++}$ and $Co^{++}$. Illustrative examples of the inorganic metal compound include basic inorganic fillers containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. Of these, as noted above, a monoxide or hydroxide is preferred. The use of magnesium oxide or calcium hydroxide, which have high reactivities with ionomer resins, is especially preferred.

The content of component C may be suitably selected so as to obtain the desired degree of neutralization. Although not subject to any particular limitation, component C may be set to a content of, based on the acid groups in components A and B, preferably at least 30 mol %, more preferably at least 45 mol %, even more preferably at least 60 mol %, and most preferably at least 70 mol %. The upper limit may be set to preferably not more than 130 mol %, more preferably not more than 110 mol %, even more preferably not more than 100 mol %, and most preferably not more than 90 mol %. The above content, expressed on a weight basis per 100 parts by weight of the base resin, is preferably from 0.1 to 10 parts by weight. In this case, the lower limit is more preferably at least 0.5 part by weight, even more preferably at least 0.8 part by weight, and most preferably at least 1 part by weight. The upper limit is more preferably not more than 8 parts by weight, even more preferably not more than 5 parts by weight, and most preferably not more than 4 parts by weight.

The above resin composition has a melt flow rate, measured in accordance with JIS-K6760 (test temperature, 190° C.; test load, 21 N (2.16 kgf)), of preferably at least 1 g/10 min, more preferably at least 2 g/10 min, and even more preferably at least 3 g/10 min. The upper limit is preferably not more than 30 g/10 min, more preferably not more than 20 g/10 min, even more preferably not more than 15 g/10 min, and most preferably not more than 10 g/10 min. If the melt flow rate of this resin composition is low, the processability may markedly decrease.

The method of preparing the above resin composition is not subject to any particular limitation, although use may be made of a method which involves charging the ionomer resins or unneutralized polymers of components A-I and A-II, together with components B and C, into a hopper and extruding under the desired conditions. Alternatively, component B may be charged from a separate feeder. The neutralization reaction by above component C as the metal cation source with the carboxylic acids in components A-I, A-II and B may be carried out with various types of extruders. Here, either a single-screw extruder or a twin-screw extruder may be used as the extruder, although the use of a twin-screw extruder is more preferred because of the large kneading effect. Alternatively, these extruders may be used in a tandem arrangement, such as single-screw extruder/twin-screw extruder or twin-screw extruder/twin-screw extruder. These extruders need not be of a special design; the use of existing extruders will suffice.

The method of producing the core using the above-described resin composition is not subject to any particular limitation. Use may be made of a known method such as shaping or injection molding, with production by injection molding being especially preferred. In such a case, in order to obtain cross-sectional hardnesses which satisfy the conditions set forth above, it is preferable to suitably select the above-described resin composition and to carry out molding in a plurality of discrete operations. The method for doing so is not subject to any particular limitation, although use may be made of a known method. For example, use may be made of a method that entails molding by injecting a predetermined resin composition over a prefabricated spherical body to be covered, or a method which entails prefabricating a pair of hemispherical half-cups from a predetermined resin composition, enclosing the body to be covered within the half-cups, and molding under applied pressure and heat at 140 to 180° C. for 2 to 10 minutes. The number of molding operations is not subject to any particular limitation, provided the above hardness conditions can be satisfied. For the purposes of this invention, so long as the entire core is formed of the same type of material, the core is regarded as having a single-layer structure.

In the practice of the invention, not only is it possible to form a core having a single-layer structure by using either the above-described rubber composition or the above-described resin composition alone, it is also possible to form a core having a multilayer structure of two or more layers by combining both. In this case, the above-mentioned methods may be suitably used as the molding method. Similarly, the number of molding operations is not subject to any particular limitation, provided the above hardness conditions can be satisfied. As noted above, for the purposes of this invention, in cases where layers made of the same type of material are mutually adjacent, the layers are regarded as a single layer, and in cases where layers made of different types of materials are mutually adjacent, the layers are regarded as a plurality of layers.

In cases where a layer formed of a resin composition is to be covered by a rubber composition, a firm bond may be achieved at the interface therebetween by pre-coating the surface of the resin composition layer with an adhesive. By firmly bonding both layers with an adhesive, the durability of the golf ball is further enhanced, enabling a high rebound to be achieved. Alternatively, interfacial adherence between the two layers can be further increased by subjecting the surface of the resin composition layer to pretreatment, such as grinding treatment with a barrel finishing machine, plasma treatment, corona discharge treatment or chemical treatment, so as to form fine surface irregularities on the surface.

The solid core has a diameter which, although not subject to any particular limitation, is preferably set to from 33 to 41 mm. The lower limit in the diameter is more preferably at least 35 mm, and even more preferably at least 37 mm. The upper limit is more preferably not more than 40 mm, and even more preferably not more than 39 mm.

In the multi-piece solid golf ball of the invention, a cover of one, two or more layers is formed so as to encase the solid core. In this invention, although not subject to any particular limitation, a known cover material may be used as the material which forms the cover. Illustrative examples include known thermoplastic resins, ionomer resins, highly neutralized ionomer resin compositions such as those described above, thermoplastic and thermoset polyurethanes, and polyamide-type and polyester-type thermoplastic elastomers. Conventional injection molding may be advantageously used to form the cover.

In the invention, of the above-described cover materials, the use of, for example, ionomer resins, highly neutralized ionomer resin compositions, thermoplastic polyurethanes and polyester-type thermoplastic elastomers is preferred. In cases where the cover is composed of a single layer, although not subject to any particular limitation, it is preferable to set the thickness to from 0.5 to 2.0 mm and to set the cover material hardness, expressed as the Shore D hardness, to from 30 to 65. As used herein, "cover material hardness" refers to the hardness of the cover material when molded into a sheet of a predetermined thickness.

When the cover is composed of two or more layers, the thickness of the inner cover layer (intermediate layer), although not subject to any particular limitation, may be set to preferably at least 0.5 mm, more preferably at least 0.7 mm, even more preferably at least 0.9 mm, and most preferably at least 1.1 mm. The upper limit also is not subject to any particular limitation, but may be set to preferably not more than 3 mm, more preferably not more than 2.7 mm, even more preferably not more than 2.5 mm, and most preferably not more than 2.3 mm. The material hardness of the inner cover layer, expressed as the Shore D hardness, although not subject to any particular limitation, may be set to preferably at least 51, more preferably at least 53, even more preferably at least 55, and most preferably at least 57. The upper limit, although not subject to any particular limitation, may be set to preferably not more than 70, more preferably not more than 67, and even more preferably not more than 64.

The thickness of the outer cover layer, although not subject to any particular limitation, may be set to preferably at least 0.3 mm, more preferably at least 0.5 mm, and even more preferably at least 0.7 mm. The upper limit also is not subject to any particular limitation, but may be set to preferably not more than 2 mm, more preferably not more than 1.7 mm, even more preferably not more than 1.4 mm, and most preferably not more than 1.2 mm. The material hardness of the outer cover layer, expressed as the Shore D hardness, although not subject to any particular limitation, may be set to preferably at least 30, more preferably at least 35, even more preferably at least 40, and most preferably at least 42. The upper limit, although not subject to any particular limitation, may be set to preferably not more than 57, more preferably not more than 55, even more preferably not more than 53, and most preferably not more than 50.

By forming the cover as described above, in addition to a distance-increasing effect, the spin performance on approach shots is also enhanced, thus enabling both controllability and distance to be achieved.

The diameter of the golf ball in which the above-described core and cover are formed should accord with golf ball standards, and is preferably not less than 42.67 mm. The upper limit, although not subject to any particular limitation, may be set to preferably not more than 44 mm, more preferably not more than 43.8 mm, even more preferably not more than 43.5 mm, and most preferably not more than 43 mm.

In the above range in the golf ball diameter, the deflection of the ball as a whole when compressed under a final load of 1,275 N (130 kgf) from an initial load of 98 N (10 kgf) (which deflection is also called the "product hardness"), although not subject to any particular limitation, is preferably at least 2.0 mm, more preferably at least 2.2 mm, and even more preferably at least 2.3 mm. The upper limit, although not subject to any particular limitation, is preferably not more than 5.0 mm, more preferably not more than 4.5 mm, even more preferably than 4.0 mm, and most preferably not more than 3.5 mm. If the above deflection is too large, a sufficient initial velocity may not be obtained on shots with a W#1. On the other hand, if the deflection is too small, the spin rate on shots with a W#1 may become too high.

In addition, the deflection of the ball as a whole when compressed under a final load of 5,880 N (600 kgf) from an initial load of 98 N (10 kgf), although not subject to any particular limitation, is preferably at least 7.2 mm, more preferably at least 7.6 mm, and even more preferably at least 8 mm. The upper limit, although not subject to any particular limitation, is preferably not more than 14 mm, more preferably not more than 12 mm, and even more preferably than 10 mm. If the above deflection is too large, a sufficient initial velocity may not be obtained on shots with a W#1. On the other hand, if the deflection is too small, the spin rate on shots with a W#1 may become too high.

Although not subject to any particular limitation, the ratio between the deflection of the solid core when compressed under a final load of 1,275 N (130 kgf) from an initial load of 98 N (10 kgf) to the deflection of the ball as a whole when compressed under a final load of 1,275 N (130 kgf) from an initial load of 98 N (10 kgf) (solid core deflection/ball deflection) is preferably from 1.30 to 1.90. The lower limit in this deflection ratio is more preferably at least 1.50, and even more preferably at least 1.60. The upper limit in this deflection ratio is more preferably not more than 1.80. If this deflection ratio is too large, the feel of the ball on impact may become too hard, whereas if the deflection ratio is too small, the spin rate of the ball on shots with a W#1 may become too high.

Moreover, although not subject to any particular limitation, the ratio between the deflection of the ball as a whole when compressed under a final load of 5,880 N (130 kgf) from an initial load of 98 N (10 kgf) to the deflection of the ball as a whole when compressed under a final load of 1,275 N (130 kgf) from an initial load of 98 N (10 kgf), expressed as (600 kgf deflection)/(130 kgf deflection), is preferably from 3.50 to 3.90. The lower limit in this deflection ratio is more preferably at least 3.55, and even more preferably at least 3.60. The upper limit in this deflection ratio is more preferably not more than 3.85, and even more preferably not more than 3.80. If this deflection ratio is too large, a sufficient initial velocity may not be achieved on shots with a W#1. On the other hand, if the deflection ratio is too small, the spin rate of the ball on shots with a W#1 may become too high.

In the golf ball of the invention, as in conventional golf balls, numerous dimples may be formed on the surface of the cover in order to further increase the aerodynamic properties and extend the distance traveled by the ball. In such a case, the number of dimples formed on the ball surface, although not subject to any particular limitation, is preferably at least 280, more preferably at least 300, and even more preferably at least 320. The upper limit in the number of dimples, although not subject to any particular limitation, may be set to preferably not more than 400, more preferably not more than 380, and even more preferably not more than 350. If the number of dimples is larger than the above range, the trajectory of the ball may become low, as a result of which a good distance may not be achieved. On the other hand, if the number of dimples is smaller than the above range, the trajectory may become high, as a result of which an increased distance may not be achieved.

The geometric arrangement of the dimples on the ball may be, for example, octahedral or icosahedral. In addition, the dimple shapes may be of one, two or more types suitably selected from among not only circular shapes, but also various polygonal shapes, such as square, hexagonal, pentagonal and triangular shapes, as well as dewdrop shapes and oval shapes. The diameter (in polygonal shapes, the lengths of the diagonals), although not subject to any particular limitation, is preferably set to from 2.5 to 6.5 mm. In addition, the depth, although not subject to any particular limitation, is preferably set to from 0.08 to 0.30 mm.

In this invention, the value $V_0$, defined as the spatial volume of a dimple below the flat plane circumscribed by the dimple edge, divided by the volume of the cylinder whose base is the flat plane and whose height is the maximum depth of the dimple from the base, although not subject to any particular limitation, may be set to from 0.35 to 0.80.

From the standpoint of reducing aerodynamic resistance, the ratio SR of the sum of individual dimple surface areas, each defined by the flat plane circumscribed by the edge of a dimple, with respect to the surface area of the ball sphere were the ball surface to have no dimples thereon, although not subject to any particular limitation, is preferably set to from 60 to 90%. This SR can be elevated by increasing the number of dimples formed, and also by intermingling dimples of a plurality of types of different diameters or by giving the dimples shapes such that the distance between neighboring dimples (i.e., the land width) becomes substantially 0.

The ratio VR of the sum of the spatial volumes of individual dimples, each formed below the flat plane circumscribed by the edge of a dimple, with respect to the volume of the ball sphere were the ball surface to have no dimples thereon, although not subject to any particular limitation, is preferably set to from 0.6 to 1 in this invention.

In this invention, by setting the above $V_0$, SR and VR values in the foregoing ranges, the aerodynamic resistance is reduced, in addition to which a trajectory enabling a good distance to be achieved readily arises and the flight performance can be enhanced.

The surface of the ball may be subjected to various types of treatment, such as surface preparation, stamping and painting, in order to enhance the design and durability of the golf ball.

As explained above, the present invention, by optimizing the hardness relationships among various areas of the solid core, enables a golf ball to be obtained which, on shots with a driver (W#1) or a middle iron, has a reduced spin rate, enabling the distance to be increased. The golf ball of the invention is also capable of having a good feel on impact.

EXAMPLES

Examples of the invention and Comparative Examples are given below by way of illustration, and not by way of limitation.

Examples 1 to 6, Comparative Examples 1 to 8

The rubber compositions shown in Table 1 below were prepared, then molded and vulcanized at 155° C. for 15 minutes to produce a spherical molding as the first layer. In Example 2, a spherical molding was obtained by injection molding using the resin material shown as No. 1 in Table 3.

To form the second layer, in the respective examples, first a pair of hemispherical half-cups was fabricated by kneading the rubber composition shown in Table 2 using mixing rolls, then carrying out primary vulcanization (semi-vulcanization) at 130° C. for 6 minutes. Next, the first layer was enclosed within the resulting half-cups and the second layer was formed by secondary vulcanization (complete vulcanization) in a mold at 155° C. for 15 minutes, thereby producing a sphere composed of the first layer covered by the second layer (second layer-covered sphere).

The third layer was formed by the same method as the second layer. More specifically, the rubber composition shown in Table 2 was kneaded using mixing rolls, then subjected to primary vulcanization (semi-vulcanization) at 130° C. for 6 minutes, thereby producing a pair of hemispherical half-cups. Next, the second layer-covered sphere was enclosed within the resulting half-cups and the third layer was formed by secondary vulcanization (complete vulcanization)

in a mold at 155° C. for 15 minutes, thereby producing a solid core which satisfies the hardness conditions of the invention.

The resin materials (cover materials) formulated as shown in Table 3 were then injection-molded over the respective solid cores, thereby forming in each case both an inner cover layer (intermediate layer) and an outer cover layer having on the surface dimples of the same shape, arrangement and number. This gave multi-piece solid golf balls composed of a solid core encased by a two-layer cover. The dimples shown in FIG. 1 were formed at this time on the cover surface. Details on the dimples are shown in Table 4.

TABLE 1

| Formulation (parts by weight) | A | B | C | D | E |
|---|---|---|---|---|---|
| Polybutadiene rubber | 100 | 100 | 100 | 100 | 100 |
| Zinc acrylate | 16.0 | 18.0 | 22.0 | 30.0 | 35.0 |
| Peroxide | 3 | 3 | 3 | 3 | 3 |
| Zinc oxide | 5 | 5 | 5 | 5 | 5 |
| Barium sulfate | 20.7 | 19.8 | 18.0 | 14.5 | 12.3 |
| Antioxidant | 0.1 | 0.1 | 0.1 | 0.1 | 0.1 |
| Zinc salt of pentachlorothiophenol | 0.4 | 0.4 | 0.4 | 0.4 | 0.4 |

TABLE 2

| | Formulation (parts by weight) | | | | | | | | |
|---|---|---|---|---|---|---|---|---|---|
| | F | G | H | I | J | K | L | M | N |
| Polybutadiene rubber | 100 | 100 | 100 | 100 | 100 | 100 | 100 | 100 | 100 |
| Zinc acrylate | 37.0 | 18.5 | 19.0 | 18.5 | 23.5 | 36.0 | 36.0 | 32.0 | 31.0 |
| Peroxide | 3 | 3 | 3 | 3 | 3 | 3 | 3 | 3 | 3 |
| Zinc oxide | 5 | 5 | 5 | 5 | 5 | 5 | 5 | 5 | 5 |
| Barium sulfate | 11.4 | 19.6 | 19.4 | 26 | 17.4 | 11.9 | 18.9 | 13.6 | 14.1 |
| Antioxidant | 0.1 | 0.1 | 0.1 | 0.1 | 0.1 | 0.1 | 0.1 | 0.1 | 0.1 |
| Zinc salt of pentachlorothiophenol | 0.4 | 0.4 | 0.4 | 0.4 | 0.4 | 0.4 | 0 | 0.4 | 0.4 |

Details on the materials in Tables 1 and 2 are given below.

Polybutadiene rubber: Available as "BR 730" from JSR Corporation. A polybutadiene rubber obtained using a neodymium catalyst; cis-1,4 bond content, 96 wt %; Mooney viscosity, 55; molecular weight distribution, 3.

Zinc acrylate: Available from Nihon Jyoryu Kogyo Co., Ltd.

Peroxide: Available as "Perhexa C-40" from NOF Corporation. 1,1-Bis(t-butylperoxy)cyclohexane diluted to 40% with an inorganic filler. Half-life at 155° C., about 50 seconds.

Zinc oxide: Available from Sakai Chemical Co., Ltd.

Barium sulfate: Available as "Precipitated Barium Sulfate 100" from Sakai Chemical Co., Ltd.

Antioxidant: Available as "Nocrac NS-6" from Ouchi Shinko Chemical Industry Co., Ltd.

TABLE 3

| Formulation (parts by weight) | No. 1 | No. 2 | No. 3 | No. 4 | No. 5 |
|---|---|---|---|---|---|
| Surlyn 6320 | | | 60 | | |
| Nucrel N035C | | | 40 | | |
| Himilan 1605 | | 50 | | | |
| Himilan 1706 | | 35 | | | |
| Himilan 1557 | | 15 | | | 50 |
| Himilan 1601 | | | | | 50 |
| Pandex T8283 | | | | 100 | |
| Magnesium stearate | | | 69 | | 0.6 |
| Magnesium oxide | | | 0.8 | | |
| Trimethylolpropane | | 1.1 | | | |

TABLE 3-continued

| Formulation (parts by weight) | No. 1 | No. 2 | No. 3 | No. 4 | No. 5 |
|---|---|---|---|---|---|
| Polyisocyanate compound | | | | 9 | |
| Hytrel 3046 | 100 | | | | |
| Hytrel 4001 | | | | 15 | |
| Titanium oxide | | | | 3.5 | 2.4 |
| Polyethylene wax | | | | 1.5 | |

Details on the materials in Table 3 are given below.

Surlyn: An ionomer resin available from E.I. DuPont de Nemours and Co.

Nucrel N035C: An ethylene-methacrylic acid-ester terpolymer available from DuPont-Mitsui Polychemicals Co., Ltd.

Himilan: Ionomer resins available from DuPont-Mitsui Polychemicals Co., Ltd.

Pandex: A MDI-PTMG type thermoplastic polyurethane available from DIC Bayer Polymer Magnesium stearate: Available as "Magnesium Stearate G" from NOF Corporation.

Magnesium oxide: Available as "Kyowamag MF150" from Kyowa Chemical Industry Co., Ltd.

Polyisocyanate compound: 4,4'-Diphenylmethane diisocyanate

Hytrel: A thermoplastic polyester elastomer available from DuPont-Toray Co., Ltd.

Titanium oxide: Available as "Tipaque R550" from Ishihara Sangyo Kaisha, Ltd.

Polyethylene wax: Available as "Sanwax 161P" from Sanyo Chemical Industries, Ltd.

TABLE 4

| No. | Number of dimples | Diameter (mm) | Depth (mm) | $V_0$ | SR | VR |
|---|---|---|---|---|---|---|
| 1 | 18 | 4.6 | 0.13 | 0.53 | 81.6 | 0.819 |
| 2 | 234 | 4.5 | 0.14 | 0.53 | | |
| 3 | 42 | 3.7 | 0.14 | 0.53 | | |
| 4 | 12 | 3.3 | 0.13 | 0.53 | | |
| 5 | 6 | 3.0 | 0.16 | 0.53 | | |
| 6 | 14 | 3.5 | 0.14 | 0.53 | | |
| Total | 326 | | | | | |

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

SR: Sum of individual dimple surface areas, each defined by the flat plane circumscribed by the edge of the dimple, as a percentage of the surface area of a hypothetical sphere were the ball to have no dimples on the surface thereof (units: %).

VR: Sum of spatial volumes of individual dimples formed below flat plane circumscribed by the edge of the dimple, as a percentage of the volume of a hypothetical sphere were the ball to have no dimples on the surface thereof (units: %).

The following properties were investigated for the golf balls obtained. Also, flight tests were carried out by the following methods, in addition to which the feel on impact was evaluated. The results are shown in Tables 5 to 8.

Cross-Sectional Hardnesses and Surface Hardness of Solid Core (JIS-C Hardnesses)

To determine the cross-sectional hardnesses of the solid core, the core was cut into two through the center, the indenter of a spring-type durometer (JIS type C) as specified in JIS K 6301-1975 was pressed perpendicularly against the cut face at predetermined positions and measurement was carried out.

To determine the surface hardness of the solid core, the indenter of a spring-type durometer (JIS type C) as specified in JIS K 6301-1975 was pressed perpendicularly against the surface of the spherical core and measurement was carried out.

The above hardnesses are the measured values obtained after holding the solid core isothermally at 23° C.

The specific places where measurement of the cross-sectional hardness and the surface hardness was carried out were as follows.

(a) center of core (b) positions 7 mm from core center (c) positions 11 mm from core center (d) core surface Material Hardnesses of Intermediate Layer and Cover (Shore D Hardnesses)

The material hardnesses of the intermediate layer and the cover were values measured with a type D durometer according to ASTM D2240 using measurement samples of the cover material prepared in the form of 6 mm thick sheets.

Deflection

Using a model 4204 test system manufactured by Instron Corporation, the balls and the solid cores were each compressed at a rate of 10 mm/min, and the deflection when compressed under a final load of 1,275 N (130 kgf) from an initial load of 98 N (10 kgf) was measured. In addition, the deflection when compressed under a final load of 5,880 N (600 kgf) from an initial load of 98 N (10 kgf) was similarly measured.

Initial Velocity of Ball

The initial velocity was measured using an initial velocity measuring apparatus of the same type as the USGA drum rotation-type initial velocity instrument approved by the R&A. The balls were held isothermally at a temperature of 23±1° C. for at least 3 hours, then tested in a room temperature (23±2° C.) chamber. Ten balls were each hit twice, and the time taken for the balls to traverse a distance of 6.28 ft (1.91 m) was measured and used to compute the initial velocity.

Distance with W#1

Each ball was hit ten times at a head speed (HS) of 50 m/s with a Tour Stage X-Drive (loft angle, 10.5°) driver (W#1), manufactured by Bridgestone Sports Co., Ltd., that had been mounted on a golf swing robot, and the spin rate (rpm) and total distance (m) were measured. The initial velocity was measured using a high-speed camera. The distance was rated according to the following criteria.

Good: 255 m or more

NG: less than 255 m

Distance with I#6

Each ball was hit ten times at a head speed (HS) of 44 m/s with a Tour Stage X-BLADE (loft angle, 28°) number six iron (I#6), manufactured by Bridgestone Sports Co., Ltd., that had been mounted on a golf swing robot, and the spin rate (rpm) and carry (m) were measured. The initial velocity was measured using a high-speed camera. The performance was rated according to the following criteria.

Good: 161 m or more

NG: less than 161 m

TABLE 5

| | | Example | | | | | |
|---|---|---|---|---|---|---|---|
| | | 1 | 2 | 3 | 4 | 5 | 6 |
| Core Structure | | single layer | two layer | single layer | single layer | single layer | single layer |
| First layer | Material | A | No. 1 | B | A | A | A |
| | Specific gravity | 1.16 | 1.07 | 1.16 | 1.16 | 1.16 | 1.16 |
| | Diameter (mm) | 10.0 | 10.0 | 10.0 | 15.0 | 10.0 | 10.0 |
| | Weight (g) | 0.6 | 0.6 | 0.6 | 2.1 | 0.6 | 0.6 |
| Second layer | Material | G | G | H | G | G | I |
| | Specific gravity | 1.16 | 1.16 | 1.16 | 1.16 | 1.16 | 1.20 |
| | Diameter (mm) | 26.0 | 26.0 | 26.0 | 26.0 | 30.0 | 26.0 |
| | Weight (g) | 10.1 | 10.1 | 10.1 | 8.7 | 15.8 | 10.4 |
| | Thickness (mm) | 8.0 | 8.0 | 8.0 | 5.5 | 10.0 | 8.0 |
| Third layer | Material | K | K | K | K | K | L |
| | Specific gravity | 1.16 | 1.16 | 1.16 | 1.16 | 1.16 | 1.20 |
| | Diameter (mm) | 38.5 | 38.5 | 38.5 | 38.5 | 38.5 | 37.7 |
| | Weight (g) | 24.1 | 24.1 | 24.1 | 24.1 | 18.3 | 22.6 |
| | Thickness (mm) | 6.3 | 6.3 | 6.3 | 6.3 | 4.3 | 5.9 |
| | Deflection (mm) | 4.3 | 4.3 | 3.9 | 4.5 | 4.4 | 4.3 |
| Hardness relationships | Cross-sectional hardness (a), JIS-C | 47 | 49 | 52 | 47 | 47 | 47 |

TABLE 5-continued

| | | Example | | | | | |
|---|---|---|---|---|---|---|---|
| | | 1 | 2 | 3 | 4 | 5 | 6 |
| | Cross-sectional hardness (b), JIS-C | 56 | 56 | 59 | 54 | 56 | 56 |
| | Cross-sectional hardness (c), JIS-C | 61 | 61 | 64 | 61 | 60 | 61 |
| | Surface hardness (d), JIS-C | 88 | 88 | 88 | 88 | 88 | 88 |
| | (b) − (a) (JIS-C) | 9 | 7 | 7 | 7 | 9 | 9 |
| | (d) − (c) (JIS-C) | 27 | 27 | 24 | 27 | 28 | 27 |
| | (a) + (b) + (c) + (d) (JIS-C) | 252 | 254 | 263 | 250 | 251 | 252 |
| | (d) − (a) (JIS-C) | 41 | 39 | 36 | 41 | 41 | 41 |
| | (c) − (b) (JIS-C) | 5 | 5 | 5 | 7 | 4 | 5 |
| | [(d) − (c)]/[(b) − (a)] | 3 | 4 | 3 | 4 | 3 | 3 |
| | [(d) − (c)]/[(c) − (b)] | 5 | 5 | 5 | 4 | 7 | 5 |

TABLE 6

| | | Comparative Example | | | | | | | |
|---|---|---|---|---|---|---|---|---|---|
| | | 1 | 2 | 3 | 4 | 5 | 6 | 7 | 8 |
| Core Structure | | single layer | single layer | single layer | single layer | single layer | single layer | single layer | single layer |
| First layer | Material | D | E | A | C | A | F | F | A |
| | Specific gravity | 1.16 | 1.16 | 1.16 | 1.16 | 1.16 | 1.16 | 1.16 | 1.16 |
| | Diameter (mm) | 28.6 | 38.5 | 25.0 | 10.0 | 10.0 | 10.0 | 10.0 | 10.0 |
| | Weight (g) | 14.3 | 34.8 | 9.5 | 0.6 | 0.6 | 0.6 | 0.6 | 0.6 |
| Second layer | Material | | | G | J | G | H | J | J |
| | Specific gravity | | | 1.16 | 1.16 | 1.16 | 1.16 | 1.16 | 1.16 |
| | Diameter (mm) | | | 32.0 | 26.0 | 26.0 | 26.0 | 26.0 | 26.0 |
| | Weight (g) | | | 10.4 | 10.1 | 10.1 | 10.1 | 10.1 | 10.1 |
| | Thickness (mm) | | | 3.5 | 8.0 | 8.0 | 8.0 | 8.0 | 8.0 |
| Third layer | Material | M | | K | K | N | M | M | M |
| | Specific gravity | 1.16 | | 1.16 | 1.16 | 1.16 | 1.16 | 1.16 | 1.16 |
| | Diameter (mm) | 38.5 | | 38.5 | 38.5 | 38.5 | 38.5 | 38.5 | 38.5 |
| | Weight (g) | 20.5 | | 14.8 | 24.1 | 24.1 | 24.1 | 24.1 | 24.1 |
| | Thickness (mm) | 19.3 | | 3.3 | 6.3 | 6.3 | 6.3 | 6.3 | 6.3 |
| | Deflection (mm) | 3.0 | 3.1 | 4.6 | 3.9 | 4.9 | 4.8 | 4.5 | 4.4 |
| Hardness relationships | Cross-sectional hardness (a), JIS-C | 65 | 67 | 47 | 59 | 47 | 75 | 75 | 47 |
| | Cross-sectional hardness (b), JIS-C | 66 | 70 | 49 | 68 | 56 | 60 | 68 | 68 |
| | Cross-sectional hardness (c), JIS-C | 73 | 72 | 53 | 75 | 61 | 64 | 75 | 75 |
| | Surface hardness (d), JIS-C | 82 | 88 | 88 | 88 | 79 | 82 | 82 | 82 |
| | (b) − (a) (JIS-C) | 1 | 3 | 2 | 9 | 9 | −15 | −7 | 21 |
| | (d) − (c) (JIS-C) | 9 | 16 | 35 | 13 | 18 | 18 | 7 | 7 |
| | (a) + (b) + (c) + (d) (JIS-C) | 286 | 297 | 237 | 290 | 243 | 281 | 300 | 272 |
| | (d) − (a) (JIS-C) | 17 | 21 | 41 | 29 | 32 | 7 | 7 | 35 |
| | (c) − (b) (JIS-C) | 7 | 2 | 4 | 7 | 5 | 4 | 7 | 7 |
| | [(d) − (c)]/[(b) − (a)] | 9 | 5 | 18 | 1 | 2 | −1 | −1 | 0 |
| | [(d) − (c)]/[(c) − (b)] | 1 | 8 | 9 | 2 | 4 | 5 | 1 | 1 |

TABLE 7

| | | Example | | | | | |
|---|---|---|---|---|---|---|---|
| | | 1 | 2 | 3 | 4 | 5 | 6 |
| Intermediate layer | Material | No. 2 | No. 2 | No. 2 | No. 2 | No. 2 | No. 3 |
| | Material hardness (Shore D) | 62 | 62 | 62 | 62 | 62 | 51 |
| | Specific gravity | 0.95 | 0.95 | 0.95 | 0.95 | 0.95 | 0.95 |
| | Diameter (mm) | 41.1 | 41.1 | 41.1 | 41.1 | 41.1 | 40.2 |
| | Weight (g) | 6.1 | 6.1 | 6.1 | 6.1 | 6.1 | 5.7 |

TABLE 7-continued

| | | Example | | | | | |
|---|---|---|---|---|---|---|---|
| | | 1 | 2 | 3 | 4 | 5 | 6 |
| | Thickness (mm) | 1.3 | 1.3 | 1.3 | 1.3 | 1.3 | 1.3 |
| Cover | Material | No. 4 | No. 4 | No. 4 | No. 4 | No. 4 | No. 5 |
| | Material hardness (Shore D) | 41 | 41 | 41 | 41 | 41 | 60 |
| | Specific gravity | 1.15 | 1.15 | 1.15 | 1.15 | 1.15 | 0.97 |
| | Weight (g) | 4.4 | 4.4 | 4.4 | 4.4 | 4.4 | 6.0 |
| | Thickness (mm) | 0.8 | 0.8 | 0.8 | 0.8 | 0.8 | 1.3 |
| Ball | Number of dimples | 326 | 326 | 326 | 326 | 326 | 326 |
| | Diameter (mm) | 42.7 | 42.7 | 42.7 | 42.7 | 42.7 | 42.7 |
| | Weight (g) | 45.5 | 45.4 | 45.5 | 45.5 | 45.5 | 45.4 |
| | Deflection (10-130 kgf) (mm) | 2.40 | 2.39 | 2.30 | 2.44 | 2.50 | 2.55 |
| | Deflection (10-600 kgf) (mm) | 8.95 | 8.91 | 8.50 | 9.15 | 9.30 | 9.18 |
| | Initial velocity (m/s) | 77.3 | 77.2 | 77.4 | 77.3 | 77.1 | 77.0 |
| Deflection ratios | Solid core/ball (10-130 kgf) | 1.79 | 1.80 | 1.70 | 1.84 | 1.76 | 1.69 |
| | Ball (600 kgf/130 kgf) | 3.73 | 3.73 | 3.70 | 3.75 | 3.72 | 3.60 |
| W#1 HS50 | Initial velocity (m/s) | 72.9 | 72.9 | 73.2 | 72.7 | 72.3 | 72.2 |
| | Spin rate (rpm) | 2750 | 2773 | 2836 | 2700 | 2674 | 2571 |
| | Total distance (m) | 256.4 | 256.0 | 255.8 | 256.8 | 255.7 | 257.8 |
| | Performance rating | good | good | good | good | good | good |
| I#6 HS44 | Initial velocity (m/s) | 55.8 | 55.9 | 56.2 | 55.7 | 55.4 | 55.5 |
| | Spin rate (rpm) | 5630 | 5703 | 5780 | 5498 | 5330 | 5205 |
| | Carry (m) | 162.1 | 161.4 | 161.2 | 163.5 | 164.8 | 166.4 |
| | Performance rating | good | good | good | good | good | good |

TABLE 8

| | | Comparative Example | | | | | | | |
|---|---|---|---|---|---|---|---|---|---|
| | | 1 | 2 | 3 | 4 | 5 | 6 | 7 | 8 |
| Intermediate layer | Material | No. 2 | No. 2 | No. 2 | No. 2 | No. 2 | No. 2 | No. 2 | No. 2 |
| | Material hardness (Shore D) | 62 | 62 | 62 | 62 | 62 | 62 | 62 | 62 |
| | Specific gravity | 0.95 | 0.95 | 0.95 | 0.95 | 0.95 | 0.95 | 0.95 | 0.95 |
| | Diameter (mm) | 41.1 | 41.1 | 41.1 | 41.1 | 41.1 | 41.1 | 41.1 | 41.1 |
| | Weight (g) | 6.1 | 6.1 | 6.1 | 6.1 | 6.1 | 6.1 | 6.1 | 6.1 |
| | Thickness (mm) | 1.3 | 20.6 | 1.3 | 1.3 | 1.3 | 1.3 | 1.3 | 1.3 |
| Cover | Material | No. 4 | No. 4 | No. 4 | No. 4 | No. 4 | No. 4 | No. 4 | No. 4 |
| | Material hardness (Shore D) | 41 | 41 | 41 | 41 | 41 | 41 | 41 | 41 |
| | Specific gravity | 1.15 | 1.15 | 1.15 | 1.15 | 1.15 | 1.15 | 1.15 | 1.15 |
| | Weight (g) | 4.4 | 4.4 | 4.4 | 4.4 | 4.4 | 4.4 | 4.4 | 4.4 |
| | Thickness (mm) | 0.8 | 0.8 | 0.8 | 0.8 | 0.8 | 0.8 | 0.8 | 0.8 |
| Ball | Number of dimples | 326 | 326 | 326 | 326 | 326 | 326 | 326 | 326 |
| | Diameter (mm) | 42.7 | 42.7 | 42.7 | 42.7 | 42.7 | 42.7 | 42.7 | 42.7 |
| | Weight (g) | 45.5 | 45.5 | 45.5 | 45.5 | 45.5 | 45.5 | 45.5 | 45.5 |
| | Deflection (10-130 kgf) (mm) | 2.30 | 2.50 | 2.65 | 2.30 | 2.60 | 2.60 | 2.50 | 2.50 |
| | Deflection (10-600 kgf) (mm) | 8.00 | 8.78 | 9.70 | 8.45 | 9.40 | 9.27 | 8.60 | 8.70 |
| | Initial velocity (m/s) | 77.5 | 77.3 | 76.9 | 77.5 | 77.0 | 77.0 | 77.1 | 77.1 |
| Deflection ratios | Solid core/ball (10-130 kgf) | 1.30 | 1.24 | 1.74 | 1.70 | 1.88 | 1.85 | 1.80 | 1.76 |
| | Ball (600 kgf/130 kgf) | 3.48 | 3.51 | 3.66 | 3.67 | 3.62 | 3.57 | 3.44 | 3.48 |
| W#1 HS50 | Initial velocity (m/s) | 73.9 | 73.0 | 71.5 | 73.2 | 72.0 | 72.7 | 73.0 | 72.7 |
| | Spin rate (rpm) | 2996 | 2874 | 2635 | 2836 | 2698 | 2823 | 2894 | 2854 |
| | Total distance (m) | 255.0 | 254.2 | 253.4 | 255.6 | 253.9 | 253.9 | 253.7 | 253.4 |
| | Performance rating | good | NG | NG | good | NG | NG | NG | NG |
| I#6 HS44 | Initial velocity (m/s) | 56.0 | 55.8 | 55.2 | 56.0 | 55.3 | 55.6 | 55.7 | 55.6 |
| | Spin rate (rpm) | 6060 | 5800 | 5225 | 5890 | 5400 | 5670 | 5860 | 5820 |
| | Carry (m) | 157.5 | 160.0 | 165.3 | 159.5 | 163.5 | 161.0 | 159.0 | 159.3 |
| | Performance rating | NG | NG | good | NG | good | good | NG | NG |

In Comparative Example 1, the value (d)−(c) was small and the value (a)+(b)+(c)+(d) was large. As a result, the spin rate on shots with an iron (I#6) was high and a good distance was not achieved.

In Comparative Example 2, the center of the core was hard and the value (a)+(b)+(c)+(d) was large. As a result, the spin rate was high and, both on shots with a driver (W#1) and on shots with an iron (I#6), a good distance was not achieved.

In Comparative Example 3, the value (a)+(b)+(c)+(d) was small and the initial velocity was low. As a result, a good distance was not achieved on shots with a driver (W#1).

In Comparative Example 4, the value (a)+(b)+(c)+(d) was large. As a result, on shots with an iron (I#6), the spin rate was high and a good distance was not achieved.

In Comparative Example 5, the value (a)+(b)+(c)+(d) was small. As a result, on shots with a driver (W#1), the initial velocity was low and a good distance was not achieved.

In Comparative Example 6, the center of the core was hard and the value (b)−(a) was less than 0. As a result, on shots with a driver (W#1), the spin rate was high and a good distance was not achieved.

In Comparative Example 7, the center of the core was hard and the value (a)+(b)+(c)+(d) was large. As a result, both on shots with a driver (W#1) and on shots with an iron (I#6), a good distance was not achieved.

In Comparative Example 8, the value (d)−(c) was small and the spin rate was high. As a result, both on shots with a driver (W#1) and on shots with an iron (I#6), a good distance was not achieved.

The invention claimed is:

1. A multi-piece solid golf ball comprising a solid core encased by a cover of one, two or more layers, wherein, letting (a) represent a JIS-C cross-sectional hardness at a center of the core on a cross-section obtained by cutting the core in half, (b) represent a JIS-C cross-sectional hardness at a position 7 mm from the core center, (c) represent a JIS-C cross-sectional hardness at a position 11 mm from the core center, and (d) represent a JIS-C surface hardness of the core:

the cross-sectional hardness (a) is in the range of 30 to 60, the cross-sectional hardness (b) is in the range of 45 to 58, the value (b)−(a) is in the range of 0 to 40, the value (d)−(c) is in the range of 20 to 40, the value (a) +(b) +(c) +(d) is in the range of 245 to 300, and the ratio between the value (d)−(c) and the value (b)−(a), expressed as [(d)−(c)]/[(b)−(a)], is from 4 to 10.

2. The multi-piece solid golf ball of claim 1, wherein the value (d)−(a) in the solid core is in the range of 25 to 55.

3. The multi-piece solid golf ball of claim 1, wherein the ratio between the deflection of the solid core when compressed under a final load of 1,275 N (130 kgf) from an initial load state of 98 N (10 kgf) to the deflection of the ball when compressed under a final load of 1,275 N (130 kgf) from an initial load state of 98 N (10 kgf) (solid core deflection/ball deflection) is from 1.30 to 1.90.

4. The multi-piece solid golf ball of claim 1, wherein the ratio between the deflection of the ball when compressed under a final load of 5,880 N (600 kgf) from an initial load state of 98 N (10 kgf) and the deflection of the ball when compressed under a final load of 1,275 N (130 kgf) from an initial load state of 98 N (10 kgf) (600 kgf deflection/130 kgf deflection) is from 3.50 to 3.90.

5. The multi-piece solid golf ball of claim 1, wherein the ratio between the value (d)−(c) and the value (c)−(b), expressed as [(d)−(c)]/[(c)−(b)], is from 3 to 8.

6. The multi-piece solid golf ball of claim 5, wherein the ratio between the value (d)−(c) and the value (c)−(b), expressed as [(d)−(c)]/[(c)−(b)], is from 5 to 8.

7. The multi-piece solid golf ball of claim 1, wherein the cross-sectional hardness (a) of the solid core is in the range of 30 to 50.

8. The multi-piece solid golf ball of claim 1, wherein the value (a)+(b)+(c)+(d) is in the range of 245 to 263.

9. The multi-piece solid golf ball of claim 3, wherein the ratio between the deflection of the solid core when compressed under a final load of 1,275 N (130 kgf) from an initial load state of 98 N (10 kgf) to the deflection of the ball when compressed under a final load of 1,275 N (130 kgf) from an initial load state of 98 N (10 kgf) (solid core deflection/ball deflection) is from 1.60 to 1.90.

10. The multi-piece solid golf ball of claim 1, wherein the cross-sectional hardness (c) of the solid core is in the range of 45 to 61.

11. The multi-piece solid golf ball of claim 1, wherein the deflection of the ball when compressed under a final load of 1,275 N (130 kgf) from an initial load state of 98 N (10 kgf) is from 2.0 to 2.44 mm.

* * * * *